United States Patent [19]

Cox et al.

[11] 4,004,754

[45] Jan. 25, 1977

[54] HIGH-SPEED, HIGH-G AIR BEARING OPTICAL MOUNT FOR ROSETTE SCAN GENERATOR

[75] Inventors: Mary V. Cox, Huntsville; Rayburn K. Widner, Arab, both of Ala.

[73] Assignee: The United States of America as represented by the Secretary of the Army, Washington, D.C.

[22] Filed: July 11, 1974

[21] Appl. No.: 487,843

[52] U.S. Cl. ..... 244/3.16

[51] Int. Cl.[2] ..... F41G 7/12

[58] Field of Search ..... 244/3.16; 250/203

[56] References Cited

UNITED STATES PATENTS

| | | | |
|---|---|---|---|
| 2,948,813 | 8/1960 | Osborne | 250/203 |
| 3,076,095 | 1/1963 | Becklund et al. | 244/3.16 |
| 3,235,733 | 2/1966 | Dauguet | 250/203 |
| 3,297,395 | 1/1967 | Dardarian | 250/203 |
| 3,756,538 | 9/1973 | McLean | 244/3.16 |

*Primary Examiner*—Verlin R. Pendegrass
*Attorney, Agent, or Firm*—Nathan Edelberg; Robert P. Gibson; James T. Deaton

[57] ABSTRACT

A missile disposed for operation from a launch pad to impinge on a target with electromagnetic rays emanating therefrom includes a seeker for direction of the rays impinging thereon in patterns for alignment therewith and means for directing the missile to the target responsive to the alignment.

4 Claims, 3 Drawing Figures

HIGH-SPEED, HIGH-G AIR BEARING OPTICAL MOUNT FOR ROSETTE SCAN GENERATOR

SUMMARY OF THE INVENTION

A missile with an electronic steering device is provided with a gimballed seeker having a scanner for directing electromagnetic rays from a target into patterns for alignment of the seeker with the rays. The steering device directs the missle to home on the target responsive to the alignment. The scanner provides a continuous line of sight with opposed optical filters disposed for discrete rotations to provide scan patterns for the alignment.

DESCRIPTION OF THE PREFERRED EMBODIMENT

Figure 1:
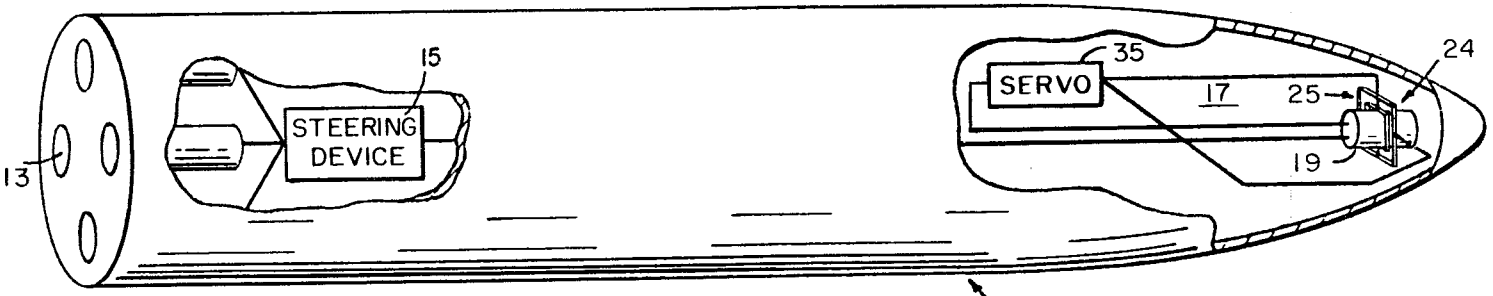
FIG. 1 is a partly cutaway view of a missile with steering means and a seeker secured therein.
Figure 3:
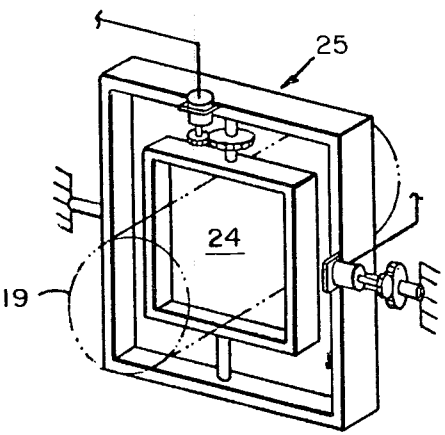
FIG. 3 is an enlarged view of the gimbal arrangement in FIG. 1.
Figure 2:
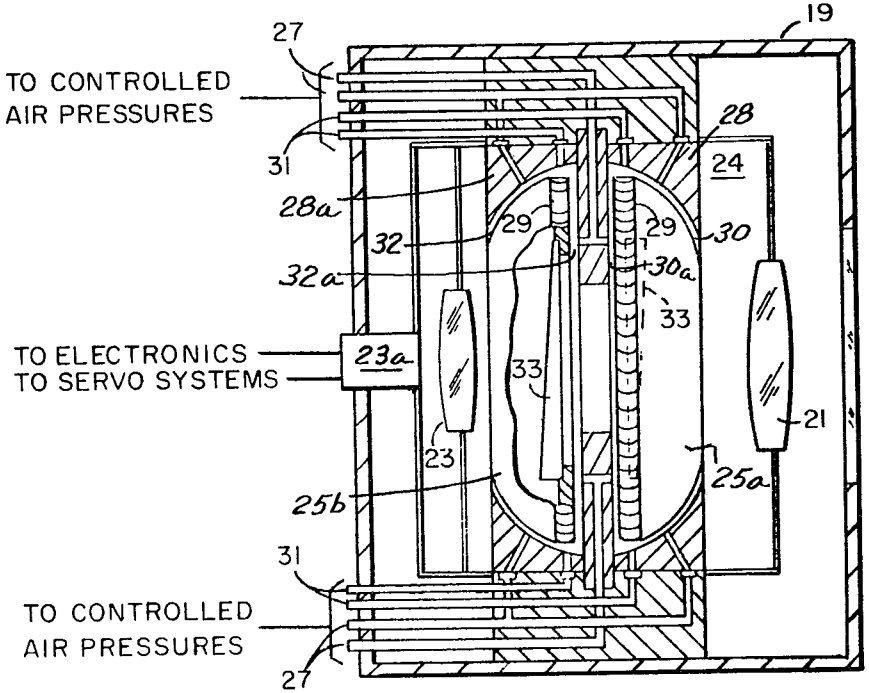
FIG. 2 is a sectional view along 2-2 of FIG. 1.

Missile 11 for operation between a launch pad and a target (not shown) is provided with a plurality of peripherally spaced propulsion means such as nozzle 13 and a device 15 for steering missile 11 such as electronic means for controlling flow of fuel to nozzles 13.

A seeker 17 includes a scanner 24 gimballed at 25 in missile 11. Scanner 24 includes tube 19 with filter 21 and collection 23 optics spaced therein for transmission therethrough of electromagnetic waves from the target. Scanner 24 includes rotor 25a, 25b carriers journaled in intermediate bearing mounts **28, 28*a* that are supplied with compressed air by sources 27 to define air bearing spaces 30, 30*a* between rotor 25*a* and bearing 28 and air bearing spaces 32, 32*a* between rotor 25*b* and bearing 28*a*. Air from the air bearing spaces is exhausted into the space within missile 11 to the atmosphere. Rotor carriers 25*a*, 25*b* each include peripheral buckets 29 in registry with compressed air sources 31 for application of discrete pressures to the buckets to produce relative rotations of rotor carriers 25*a* and 25*b*. Rotor carriers 25*a* and 25*b* are centrally pierced and optical prisms 33 are oppositely disposed on the respective carriers to direct the electromagnetic rays from predetermined target scan patterns onto conventional detector 23*a* such as an infrared or ultraviolet detector. A servo device 35 of seeker 17 can be used to direct scanner 24 to alignment with the electromagnetic rays responsive to the predetermined patterns by utilizing signals from detector 23*a*. Steering device 15 is disposed to direct missile 11 to home on the target responsive to the alignment in response to electronic signals from detector 23*a***.

The predetermined target scan patterns can be varied in accordance with the respective rotations of carriers **25*a* and 25*b* produced by predetermined pressures in compressed air sources 31** to include a straight line, a circle or rosette figures with multiple lobes to produce scan patterns desirable for particular detection applications. For the prototype described the speeds are substantially 6000 and 18000 RPM to produce a scan pattern with (23) leaves for clarity of target definition within a scan area.

We claim:

1. A scan generator comprising: a tube with filter and collection optics spaced therein for transmission therethrough of electromagnetic waves from a target, a pair of intermediate bearing mounts mounted in said tube between said filter and collection optics, a pair of rotor carriers journaled in said pair of intermediate bearing mounts to define an air bearing space between each bearing mount and its respective rotor carrier, means for supplying a source of compressed air to the air bearing space between each bearing mount and its respective rotor carrier to mount said rotor carriers on an air bearing, said rotor carriers having peripheral buckets in registery with compressed air supplied through said bearing mounts for application of discrete pressures to the buckets to produce relative rotations of the rotor carriers, said rotor carriers being centrally pierced and having optical prisms oppositely disposed on the respective rotor carriers to direct said electromagnetic waves from a predetermined target scan pattern to said collection optics for transmission to a detector.

2. A scan generator as in claim 1 with said filter optics disposed for transmission of ultra-violet rays.

3. A scan generator as in claim 1 with said filter optics disposed for transmission of infrared rays.

4. A scan generator as in claim 1, wherein said scan generator is gimbled in a missile to act as a seeker for the missile.

* * * * *